US009145724B2

(12) United States Patent
Dudley et al.

(10) Patent No.: US 9,145,724 B2
(45) Date of Patent: Sep. 29, 2015

(54) FLOOR-MOUNTING GATE-CLOSER POST WITH ROTARY DAMPENER

(71) Applicants: David Edmond Dudley, Oregon City, OR (US); Simon David Dudley, Campbell, CA (US)

(72) Inventors: David Edmond Dudley, Oregon City, OR (US); Simon David Dudley, Campbell, CA (US)

( * ) Notice: Subject to any disclaimer, the term of this patent is extended or adjusted under 35 U.S.C. 154(b) by 0 days.

(21) Appl. No.: 14/663,561

(22) Filed: Mar. 20, 2015

(65) Prior Publication Data

US 2015/0191955 A1 Jul. 9, 2015

Related U.S. Application Data

(60) Provisional application No. 61/972,367, filed on Mar. 30, 2014.

(51) Int. Cl.

| | |
|---|---|
| ***E05F 15/02*** | (2006.01) |
| ***E05F 3/08*** | (2006.01) |
| ***E05F 15/53*** | (2015.01) |
| ***E05F 11/54*** | (2006.01) |
| ***E05F 5/08*** | (2006.01) |

(52) U.S. Cl.

CPC ... *E05F 3/08* (2013.01); *E05F 5/08* (2013.01); *E05F 11/54* (2013.01); *E05F 15/53* (2015.01)

(58) Field of Classification Search

CPC ..... E05F 3/08; E05F 15/53; E05F 11/54; E05F 5/08; Y10T 16/53828; Y10T 16/53845; Y10T 16/2771

USPC ..... 49/42, 43, 49, 333, 334; 16/285, 295, 16/54; 256/73

See application file for complete search history.

(56) References Cited

U.S. PATENT DOCUMENTS

| | | | | | |
|---|---|---|---|---|---|
| 957,603 | A * | 5/1910 | Ellis | 16/285 |
| 1,236,536 | A * | 8/1917 | Boyd | 16/285 |
| 1,540,490 | A * | 6/1925 | Mertel | 49/381 |
| 4,472,908 | A * | 9/1984 | Wanzl et al. | 49/25 |
| 4,665,650 | A * | 5/1987 | Hall | 49/334 |
| 4,731,886 | A * | 3/1988 | Heinrich et al. | 49/334 |
| 5,035,082 | A * | 7/1991 | Butler | 49/334 |
| 5,373,664 | A * | 12/1994 | Butler | 49/358 |
| 7,155,779 | B2 * | 1/2007 | Watkins | 16/316 |
| 7,367,161 | B1 * | 5/2008 | Jones | 49/334 |
| 7,506,860 | B2 * | 3/2009 | Stull | 256/73 |
| 7,697,674 | B2 * | 4/2010 | Nassimi | 379/167.02 |
| 7,958,675 | B2 * | 6/2011 | Stull | 49/324 |
| 8,341,888 | B2 * | 1/2013 | Stull | 49/237 |
| 8,584,401 | B2 * | 11/2013 | Planck et al. | 49/49 |
| 8,915,017 | B2 * | 12/2014 | Linnenkohl | 49/334 |
| 2005/0156149 | A1 * | 7/2005 | Stull | 256/73 |
| 2008/0229666 | A1 * | 9/2008 | Jones | 49/334 |
| 2010/0101147 | A1 * | 4/2010 | Vankrunkelsven | 49/334 |
| 2011/0120018 | A1 * | 5/2011 | Bode | 49/334 |

* cited by examiner

*Primary Examiner* — Jerry Redman

(74) *Attorney, Agent, or Firm* — Richard Brewster Main; Main Cafe

(57) ABSTRACT

A hydraulic closer and dampener that can be removed and replaced by opening a post cap to then lift an internal closer assembly out of the top of an internally pivotable shaft inside a free-standing floor-mounted post. The remainder of the gate mechanism remains functional during such service. An automatic closing speed adjustment is easy to access and set. There are no external hinges, the gate pivots on an axis coaxial to the cylindrical post.

7 Claims, 20 Drawing Sheets

FLOOR-MOUNTING GATE-CLOSER POST WITH ROTARY DAMPENER

BACKGROUND OF THE INVENTION

1. Field of the Invention

The present invention relates to industrial pedestrian control gates and fences as used in metro-stations, and more particularly to hollow, cylindrical, floor mounting gate posts with closing dampeners that allow the gate to hinge on an axis coaxial to the post.

2. Description of Related Art

Train, airline, bus, and other transportation stations all employ gates and turnstiles to control and secure various areas. These gates very often have to be able to swing both ways, and some also need to be able to latch securely.

Station agents in secure booths often need to be able to unlock the gates briefly to let authorized riders and ticketholders through. Very often the way this is done in conventional systems is to use an electro-mechanical lock mechanism at the gate with wires buried in the ground or installed in the floors and walls connected to a control switch in the secure booth.

Such lock systems must survive energetic efforts by criminals to kick the gates down, and still be failsafe in the event of a power failure. The gates must unlatch when power is lost so as to not trap people from escape. David Dudley describes such a locking mechanism for a bi-swing train station gate in U.S. Pat. No. 8,186,729, issued May 29, 2012, titled TRAPLOCK FOR BI-SWING GATE (Dudley '729).

Conventional gate and post construction used throughout America are difficult and expensive to manufacture, install, operate, and maintain. What is needed is a gate system with a post mechanism that is easy and inexpensive to manufacture, install, operate, and maintain. One key to all of this is the elimination of external hinges.

SUMMARY OF THE INVENTION

Briefly, a hydraulic closer and dampener embodiment of the present invention comprises an assembly that can be removed and replaced by opening a post cap to then lift an internal closer unit out of the top of an internally pivotable shaft inside a free-standing floor-mounted post. The remainder of the gate mechanism remains functional during such service. An automatic closing speed adjustment is easy to access and set. There are no external hinges, the gate pivots on an axis coaxial to the cylindrical post. The external appearance can therefore be clean, modern, and stylish.

Other and still further objects, features, and advantages of the present invention will become apparent upon consideration of the following detailed description of specific embodiments thereof, especially when taken in conjunction with the accompanying drawings.

DETAILED DESCRIPTION OF THE INVENTION

All embodiments of the present invention operate with a gate hung from an internally pivotable shaft inside a free-standing floor-mounted post to eliminate external hinges. This arrangement allows a compact rotary closer mechanism to be used to dampen and slow down gate returns to the gate-closed position. Such mechanisms can be based on the frictional resistance offered by clutch discs, or as more fully detailed herein on hydraulic cylinders and chambers with fluid channel restrictors. An important benefit of hanging a gate from the internally pivotable shaft inside the free-standing floor-mounted post is serviceability. The compact rotary closer mechanism can be configured as an assembly that can be removed and replaced by opening a post cap to then lift the whole closer unit out of the top. The remainder of the gate mechanism remains functional during such service. Since the compact rotary closer mechanism is located inside the top of the post, an automatic closing speed adjustment can be included that is easy to access and set. Because there are no external hinges, the external appearance can be clean, modern, and stylish.

Some embodiments of the present invention include an electro-mechanical lock installed vertically in an adjacent latch post, others do not. The locks when used are placed near the tops in pockets for maximum leverage on the gates.

Each electro-mechanical lock has two catches that can protrude out and lock on either side of the gate to prevent the gate opening. The electro-mechanical locks are installed in pockets beside the gates such that the gates will cover and protect them when the gate is in their locked positions. A sensor detects if the gate is open. The gate is allowed to swing open when the respective catches are unlatched by a solenoid or electro-mechanical actuator. As the gate is opened, the catches protrude back out to catch the gate when it automatically recloses. A double acting spring in a pivot post will return the gate, and is slowed down by a double acting hydraulic closer.

The gate is trapped and not allowed to swing open when the respective catches are held latched by a second solenoid and a teeter arm. Such solenoids are arranged in battery powered models to require only brief pulses of power to put the catches in their locked states or unlocked states. A capacitor is employed to store enough energy after power is lost to kick the solenoids into the unlocked state.

Figure 1A:
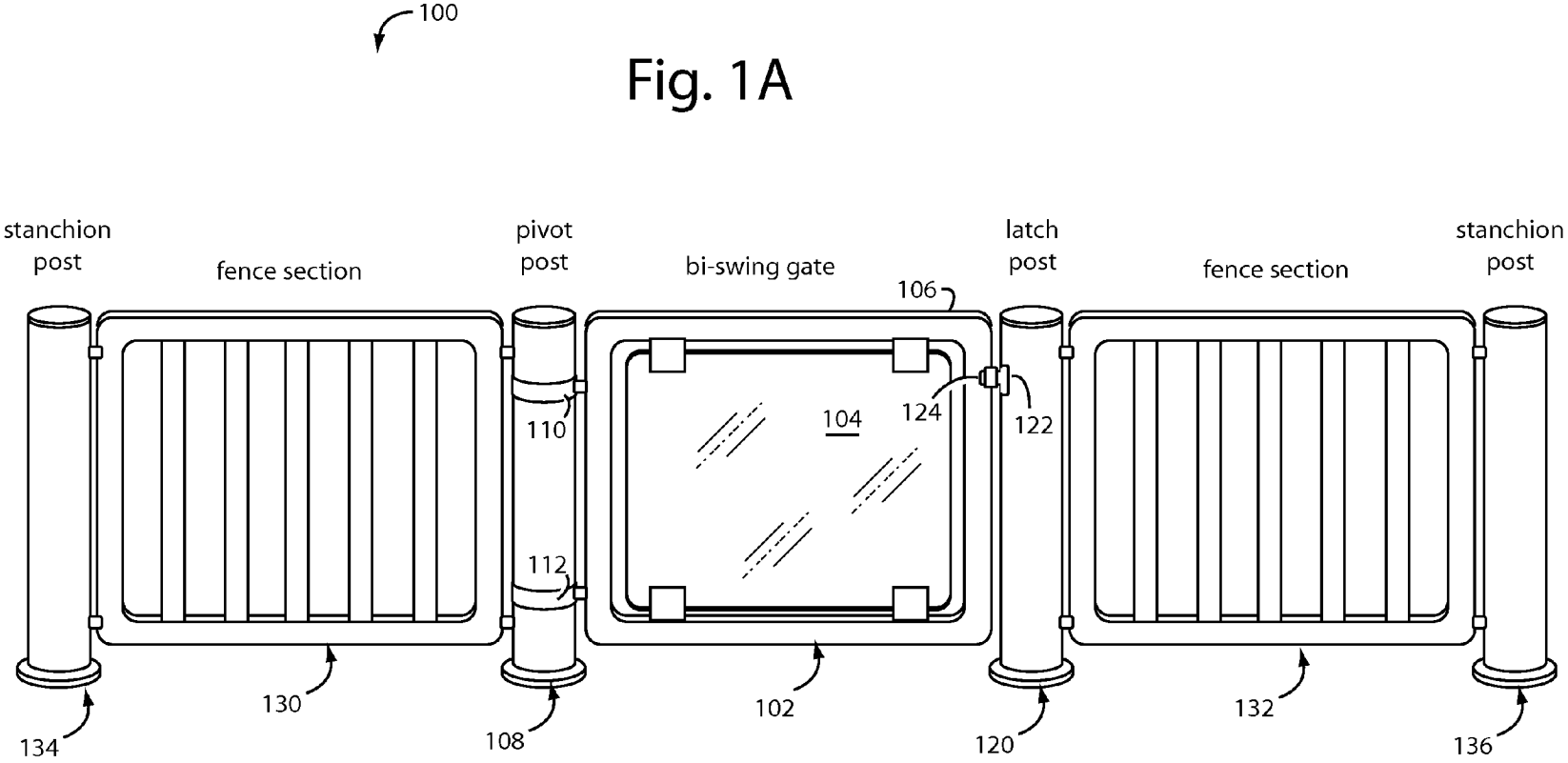
FIGS. 1A and 1B are perspective view diagrams of a metro-station gate and fence system with a bi-swing secure area gate latch that installs an electro-mechanical lock vertically in the latch post adjacent.
Figure 1B:
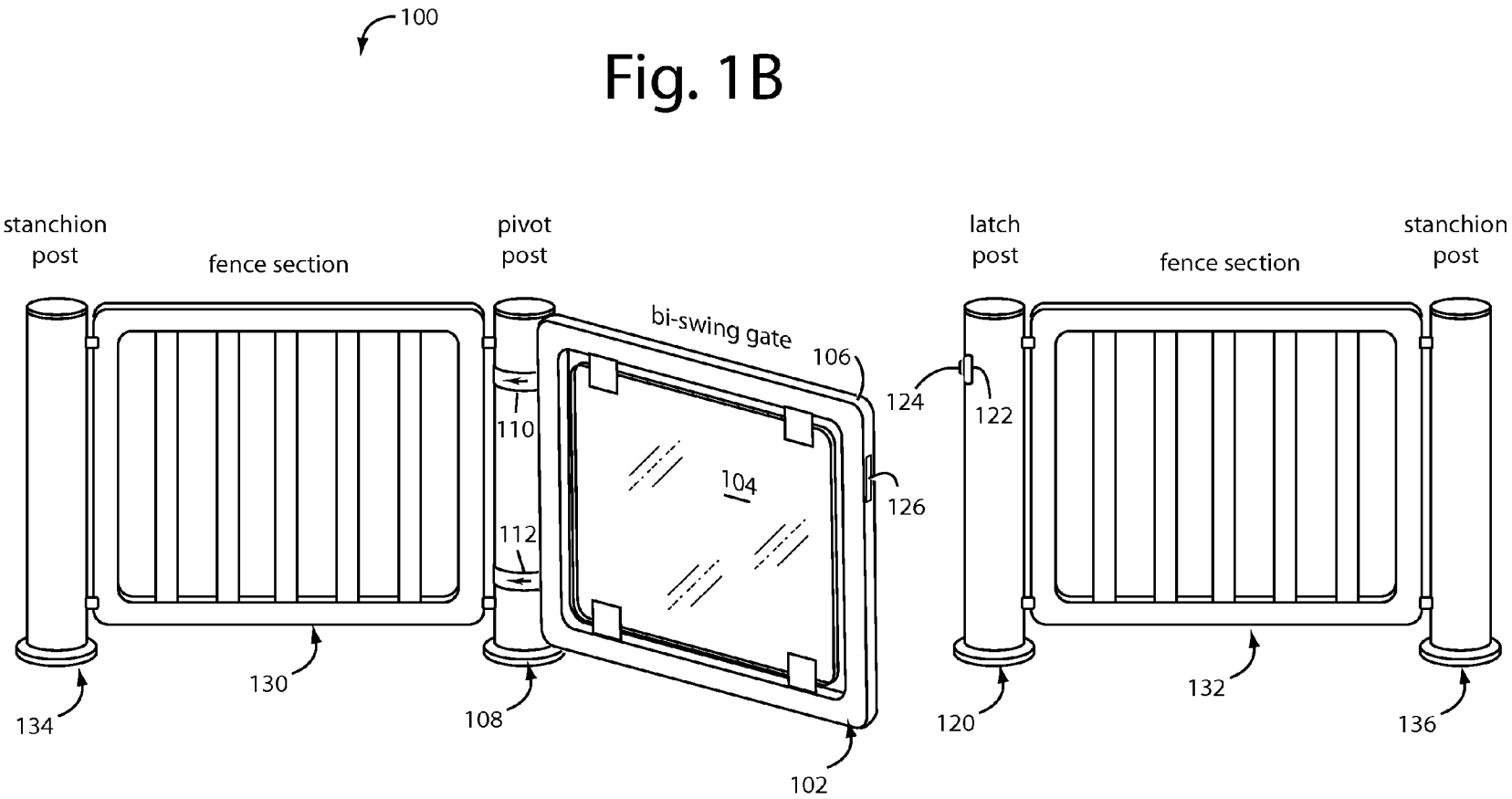

FIGS. 1A and 1B represent a metro-station gate and fence system 100 in an embodiment of the present invention. A bi-swing gate 102 with a glass panel 104 and a frame 106 of square stainless steel tubing are attached at two points to a pivot post 108 through rotating slip ring collars 110 and 112. A latch post adjacent to the distal end of gate 102 has a traplock 122 positioned inside a pocket and an exposed latch 124 can be seen trapping gate 102 closed. An early version of traplock 122 is described in U.S. Pat. No. 8,186,729, issued May 29, 2012, titled TRAPLOCK FOR BI-SWING GATE (Dudley '729). This traplock 122 is capable of battery and wireless operation for situations where it is not practical to install wiring in the floor.

Figure 3:
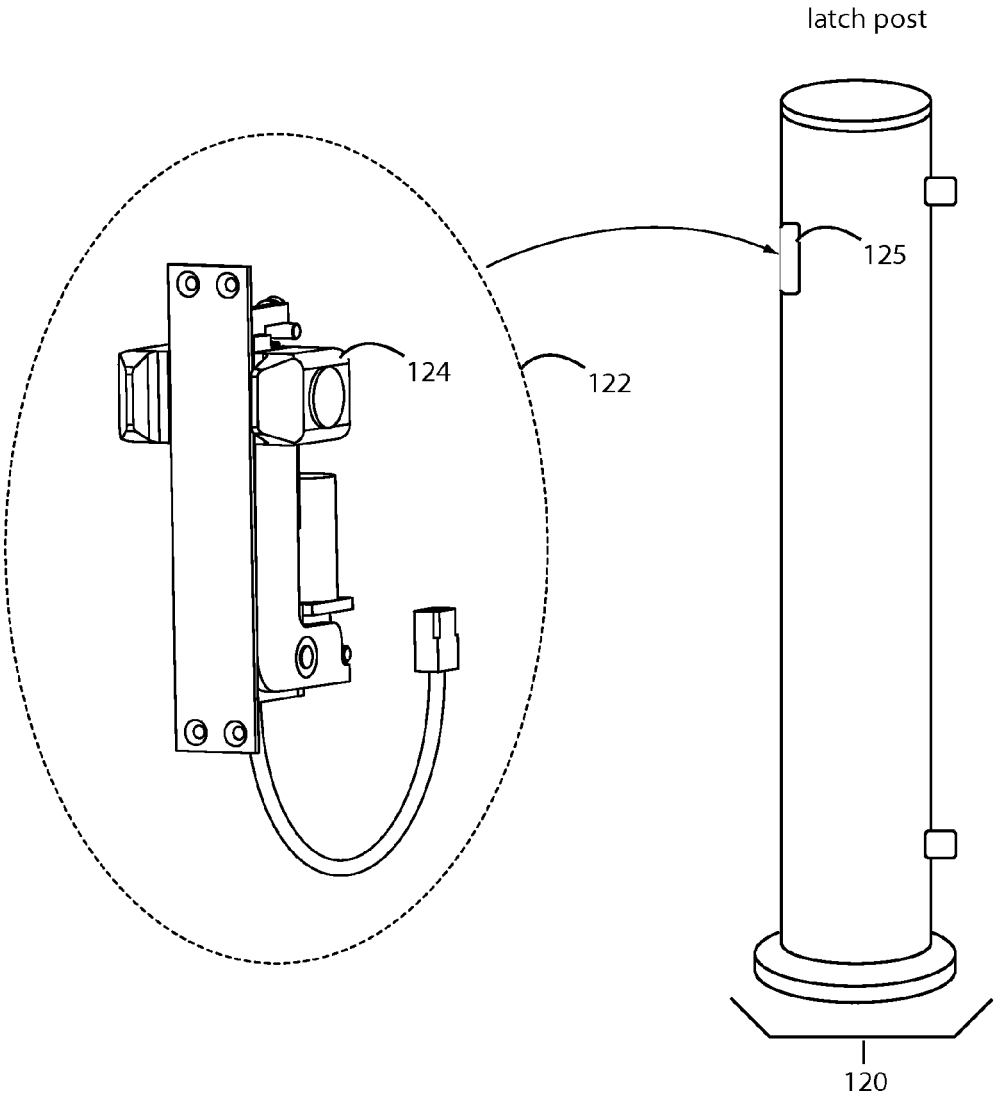
FIG. 3 is an exploded assembly view of the latch post used in the system of FIGS. 1A and 1B, and shows the pocket to accept the traplock.

Traplock 122 fits inside a pocket 125, as shown only in FIG. 3.

A magnetic latch plate 126 (FIG. 1B only) provides a magnet detectable by a Hall Effect device or reed switch. These prove an electronic indication to signal traplock 122 when gate 102 is closed and ready to be locked. Until then latch 124 is either fully retracted inside latch post 120 or will be easily pushed in by the closing of gate 102 from either direction.

Fence sections 130 and 132 are typical of many such sections and are supported every several feet by stanchion posts 134 and 136, or terminate at a wall, a pivot post 108 or latch post 120. The usual construction of almost every part and component is stainless steel.

The rotating slip ring collars 110 and 112 turn with gate 102 as it opens and closes. This implies that the center axis of turning is coaxial to the longitudinal axis of pivot post 108. The result is no pinch points form around pivot post 108 and when the gate 102 is fully open the open clearance is the full inside width between pivot post 108 and latch post 120. There is no interference from the hinges as is common in conventional doors and gates.

Figure 2:
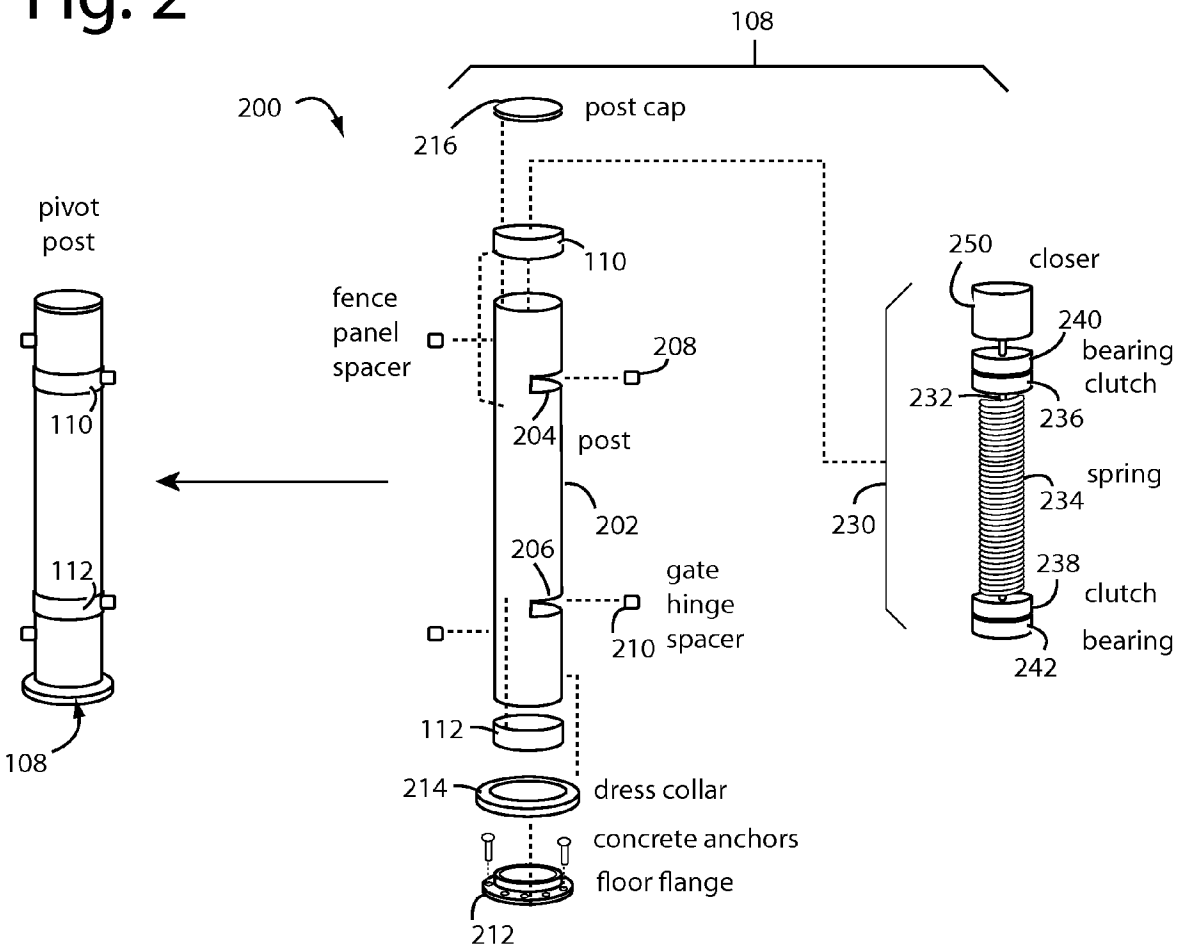
FIG. 2 is an exploded assembly view of the pivot post used in the system of FIGS. 1A and 1B.

FIG. 2 represents one way to assemble pivot post 108. A pivot post assembly 200 provides a round tubular pipe 202 typically 4-inches in diameter and 4-feet tall. Upper and lower hinge slots 204 and 206 are cut about 180-degrees around the face adjacent to gate 102. Gate hinge spacers 208 and 210 are attached to gate 102 and will travel left and right inside slots 204 and 206 as gate 102 is moved. Spacers 208 and 210 respectively pass through rotating slip ring collars 110 and 112, and cause them to turn with the gate.

In battery operated models, a low voltage condition caused by the battery dying will cause a shutout that includes pulsing the unlatch solenoid so the teeter arm will be pulsed out of the way and springs can withdraw the catches into the pockets. The gate is unlocked when those with authorized access are recognized. Wireless and wired controls, and even RFID badge readers can be used to unlock the gates.

Post 202 is anchored to the floor with a floor flange 212 and conventional concrete anchors or lag bolts. A collar 214 covers the floor flange to give a finished appearance. A post cap 216 fits on top.

Inside post 202 there is a spring assembly 230. An axle 232 coaxially carries a torsion type spring 234. The spring 234 is anchored at its top to a one-way clutch 236 and at its bottom to an opposite one-way clutch 238. For example, a clockwise one-way clutch will prevent rotation in the clockwise direction of turning, but not the counter-clockwise direction.

In operation, swinging gate 102 in will lock one of the one-way clutches 236 and 238, and allow the other to rotate against pressure to stay closed from spring 234. Swinging gate 102 out will lock the other of the one-way clutches 236 and 238, and allow the first to rotate against pressure to stay closed from spring 234. Spring 234 operates the same direction no matter which way gate 102 swings. Bearings 240 and 242 Provide support for axle 232. Gate hinge spacers 208 and 210 respectfully attach directly to axle 232 inside post 202.

A hydraulic closer 250 hydraulically controls how fast gate 102 can be opened or close on its own. A "flag" attached to axle 232 inside closer 250 sweeps through a volume filled with hydraulic fluid. Interconnecting ports and passageways control how fast the flag can sweep inside the volume. At the last few degrees of gate travel, that hydraulic resistance increases substantially to prevent torqueing and damage to the assembly 200.

Rubber O-rings can be used around closer 250, bearings 240 and 242, and clutches 236 and 238 inside post 202 to prevent rattling and remove any sloppiness in the parts fittings. Raw piping material available for post 202 is often not very round nor precisely dimensioned.

FIG. 3 shows how traplock 122 fits inside pocket 125 in latch post 120.

FIGS. 4A-4F represent a double-acting gate lock embodiment of the present invention, and is referred to herein by general reference numeral 400. The lock 400 is built on a base plate 402 that screws into a gate casing pocket, e.g. pocket 125 in FIG. 3. A frame 404 is mounted to the base plate 402 and has a pair of keeper tabs 406 and a pivot bulkhead 408. A pivot shaft 410 on bearings passes through two catch arms 412 and 414. These arms have limited motion and carry catch blocks 416 and 418 on their respective distal ends. A rubber cushion 420 and 422 are attached on the outside faces of catch blocks 416 and 418.

The motion of the two catch arms 412 and 414 is limited at one extreme by base plate 402. When catch arms 412 and 414 contact base plate 402 along their bottom lengths, the catch blocks 416 and 418 will protrude to their maximum extent out of the gate casing pocket to capture the top edge of an adjacent bi-swing gate. Gravity will ordinarily cause the catch arms 412 and 414 to protrude into the locked position of FIG. 4A. The motion of the two catch arms 412 and 414 is limited at the other extreme by a teeter pin 424.

Figure 4A:
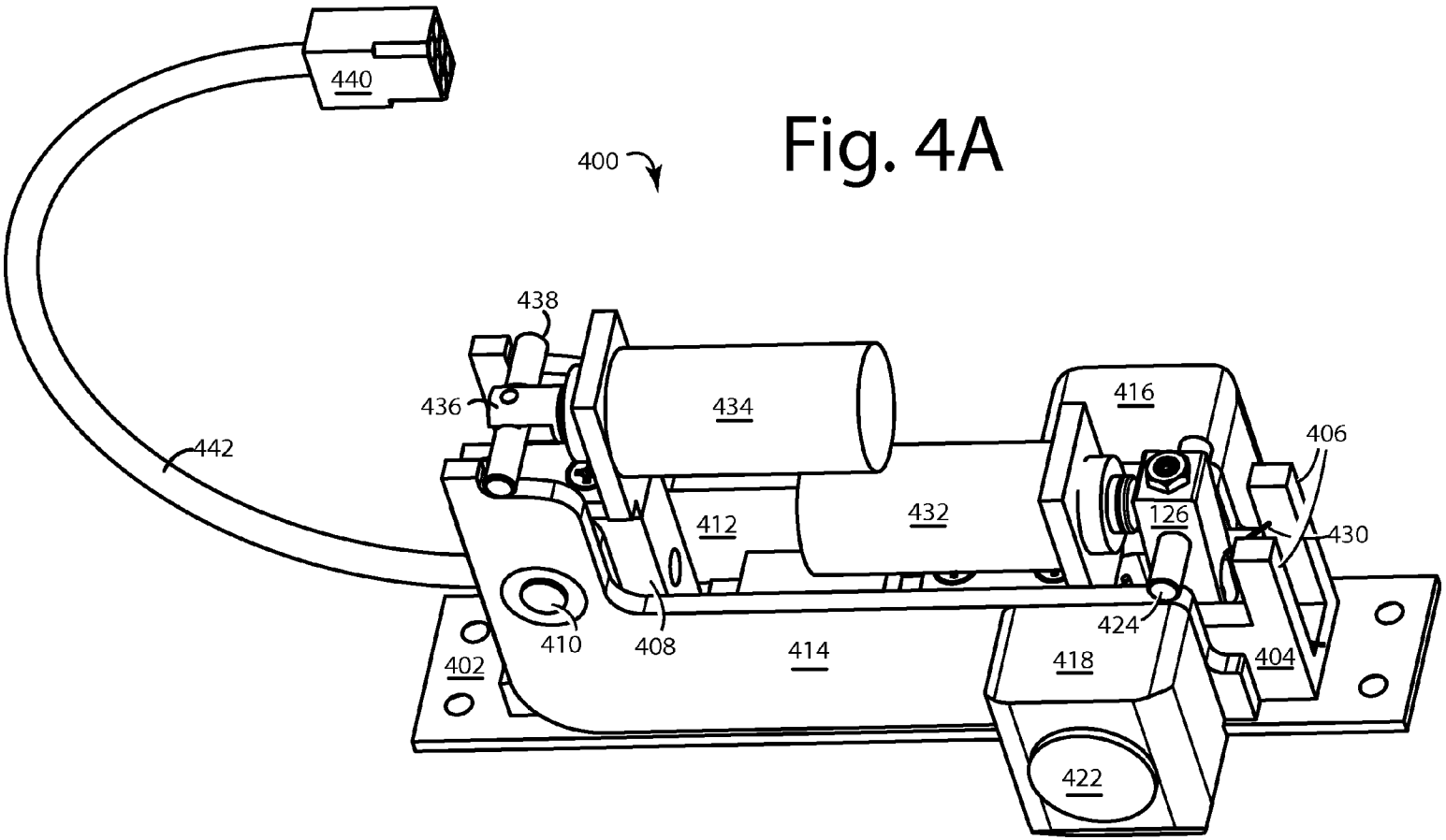
FIGS. 4A-4F are various perspective view diagrams of a double-acting gate lock (traplock) in a utility powered embodiment of the present invention.
Figure 4B:
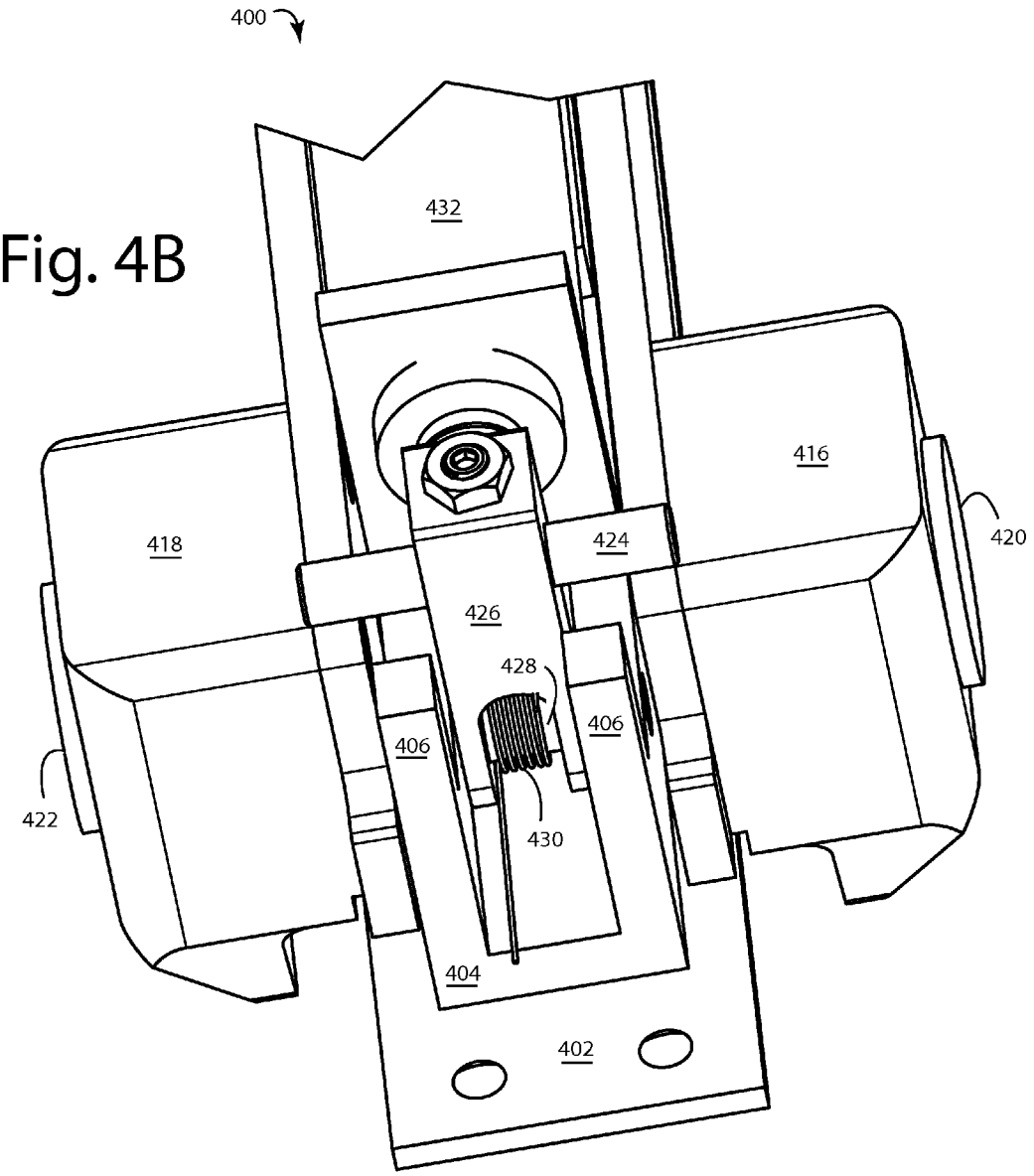
Figure 4C:
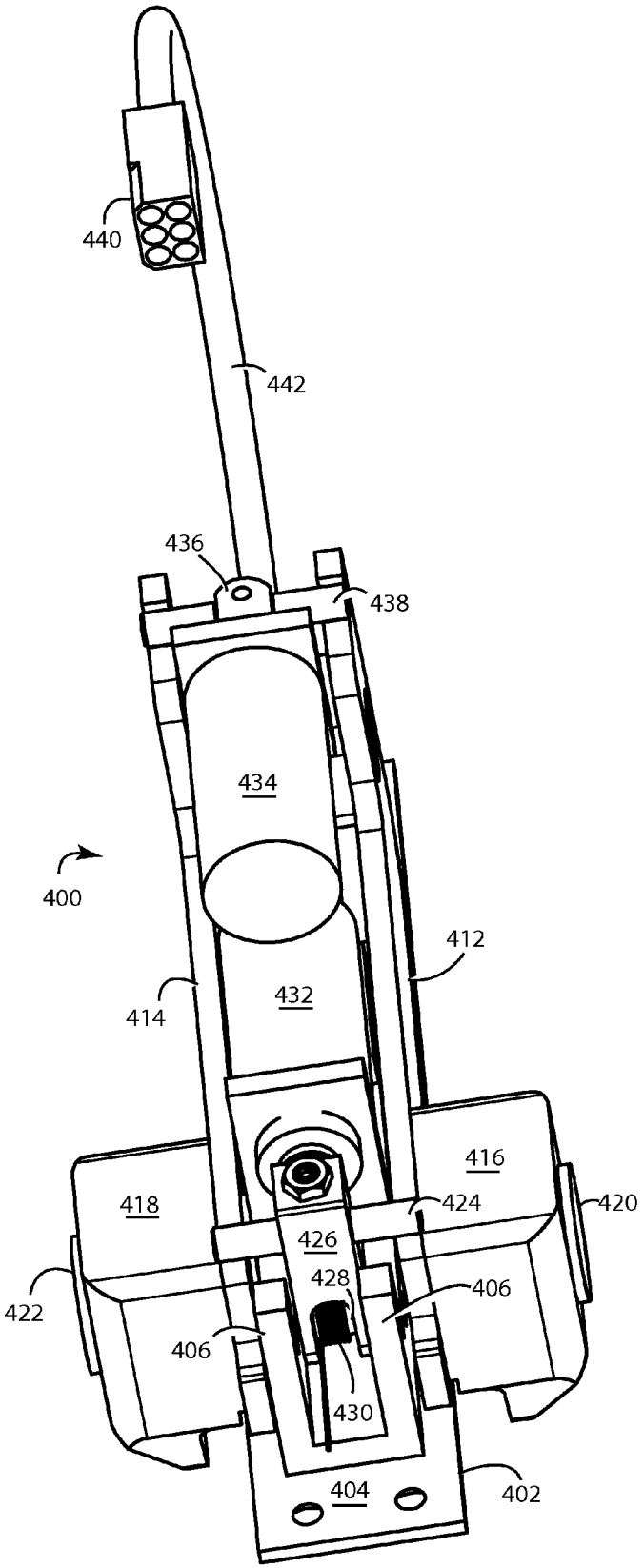

Teeter pin 424 is carried by a teeter arm 426 that can teeter back and forth on a shaft 428 (FIGS. 4B, 4C). A torsion spring 430 mounted on shaft 428 presses the teeter arm and the teeter pin 424 it carries against the top distal corner of catch arms 412 and 414. If the catch arms 412 and 414 are in the position shown in FIG. 4A, the teeter pin will ride over the top and lock catch arms 412 and 414 so they cannot move up to unlock.

Figure 4D:
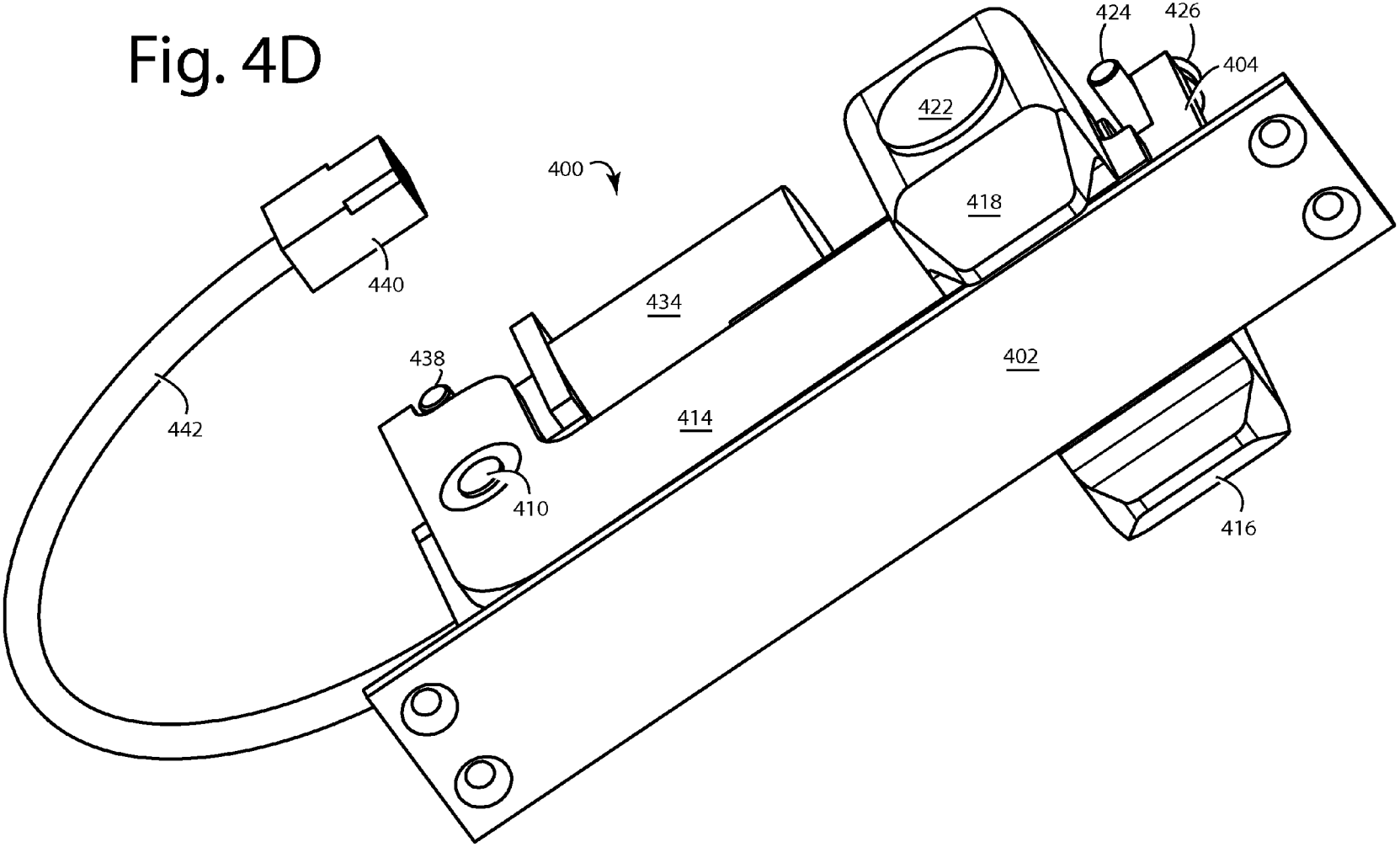
Figure 4E:
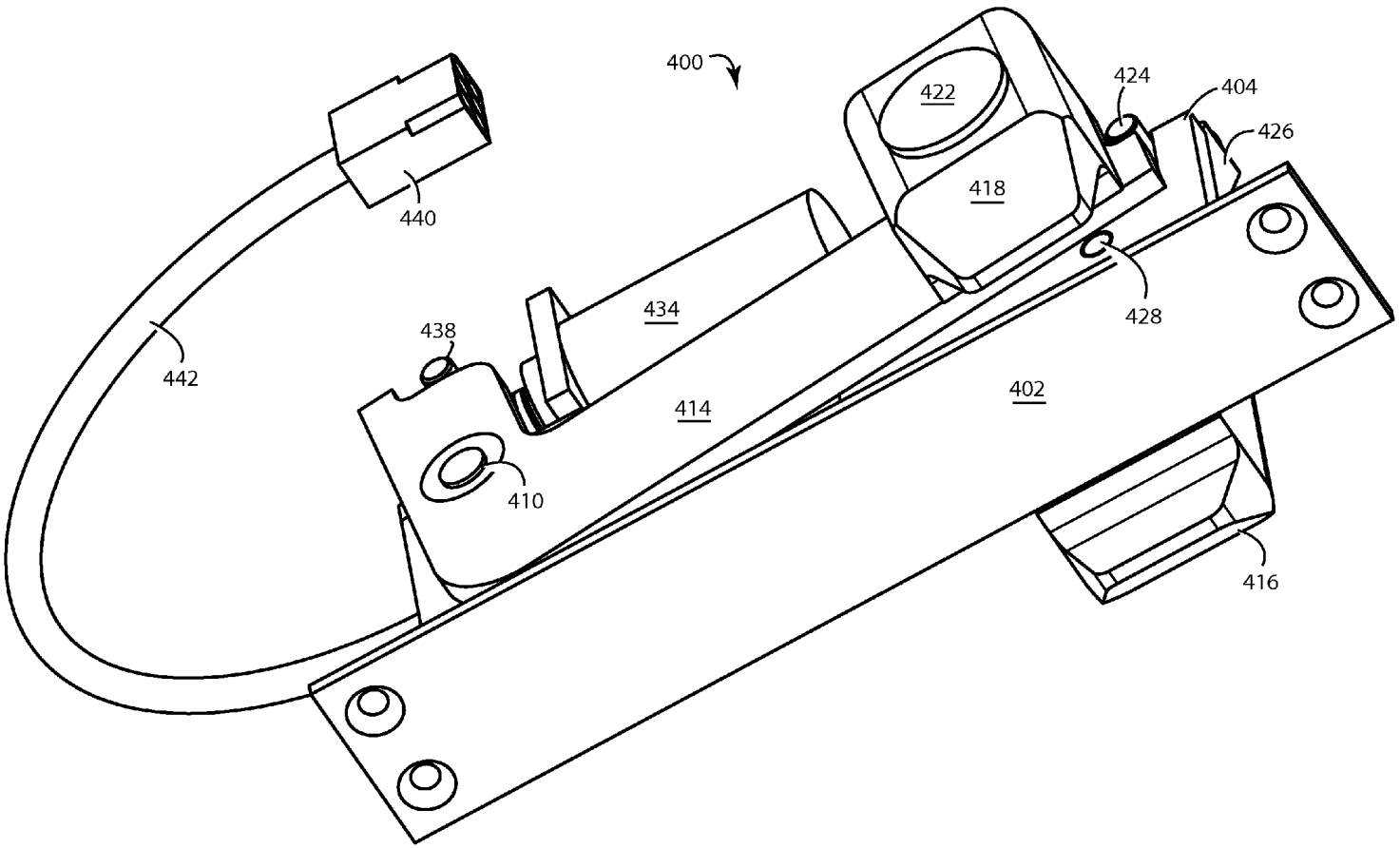
Figure 4F:
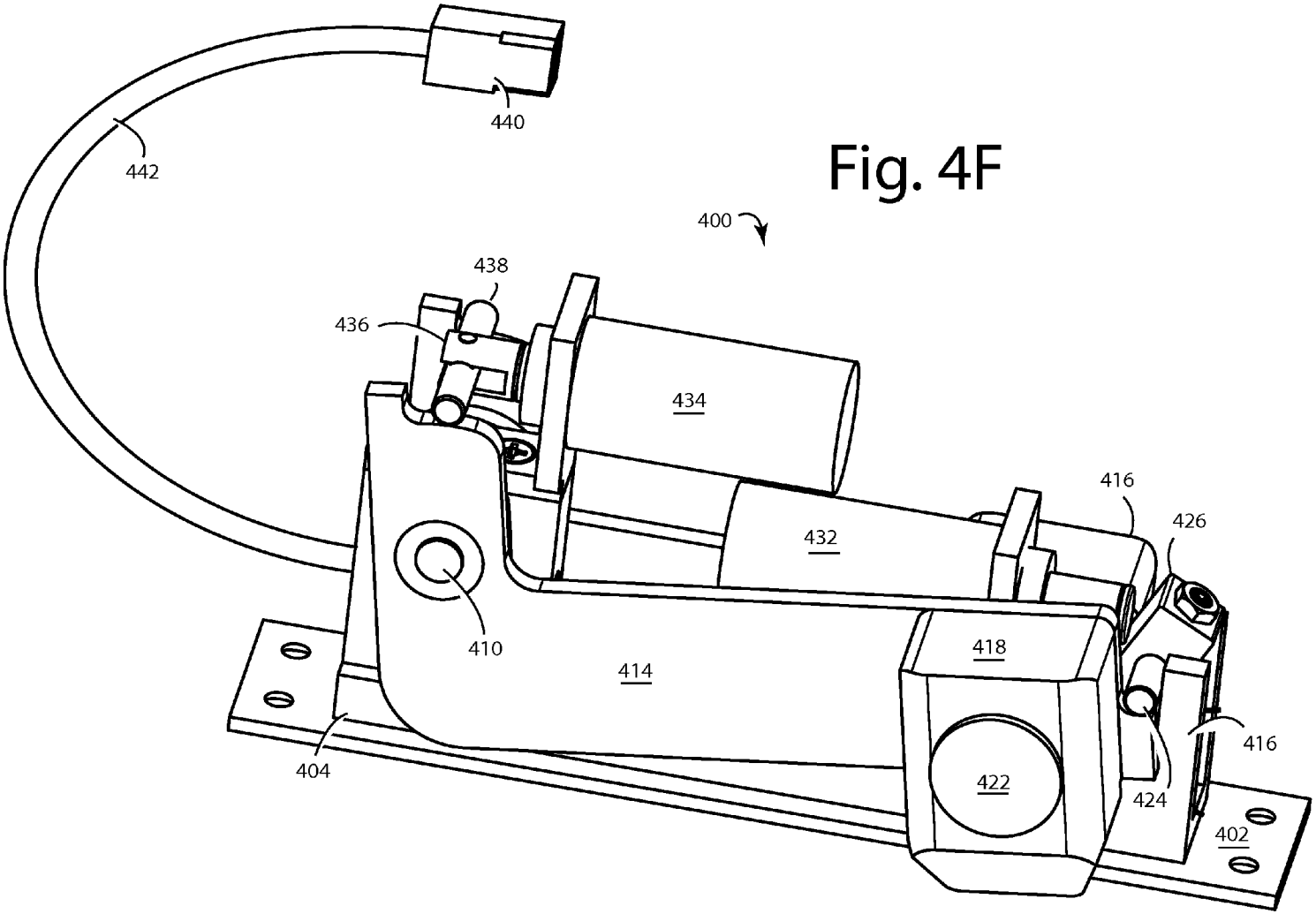

But, if either of catch arms 412 and 414 are in their raised position, such as is shown in FIG. 4F, teeter pin 424 cannot get over to lock out catch arms 412 and 414.

A fail safe lock embodiment shown in FIGS. 4D-4F represents a hard-wired, utility powered version in which its teeter arm solenoid is normally extended by a spring. Such unlocks the arms. A fail secure version of the hard wired lock would employ a normally retracted solenoid like the one shown in FIG. 2A-D A teeter solenoid 432 has an armature normally extended by a spring. When the solenoid is de-energized, the spring is allowed to push the armature out against the teeter arm 426, causing teeter pin 424 to unlatch from the tops of catch arms 412 and 414. FIGS. 4D-4F show teeter solenoid 432 de-energized and teeter arm 426 pushed over. Catch arms 412 and 414 are enabled to raise if a catch arm solenoid 434 is also de-energized. An internal spring is provided to push out a clevis 436 mounted with a bridge pin 438.

In battery powered embodiments, gate lock 400 is configured to have two stable conditions that require no power to maintain. One is a failsafe mode that unlocks the gates when utility power fails or the battery runs out. The other is the locked condition that keeps the gates closed as long as the control electronics are operating normally.

However, FIGS. 4A-4F show the alternative utility powered embodiment in which power is used to maintain the locked condition. Such is not always the case or desirable. Particular secure applications may require the locks, their solenoids, and springs to be configured to automatically lock and stay locked if power is lost. This would be appropriate were no workers or members of the public would become trapped or endangered by such a configuration.

Connections are made to a lock controller using a connector 440 and a pigtail lead 442. For example, lock controller 320 in FIG. 3.

FIGS. 5A-5D represent a bi-swing gate locking installation 500 in a battery powered embodiment of the present invention that uses a lock similar to lock 400 of FIGS. 4A-4F. The main differences are in which directions the solenoids will move when energized, and in the respective positions the internal springs will return them to. All embodiments can be configuration to be fail-safe (gates unlock) or fail-secure (gates lock) upon power failure.

A part of a gate casing 502 is illustrated with a pocket 504 positioned adjacent of a double acting swing gate 506. A catch solenoid 510 and a teeter solenoid 512 are arranged to work in cooperation. An armature 514 on solenoid 510 is configured to push catch arms 516 so that they will lift up catches 518 and unlock gate 506 for either direction.

In fail safe embodiments, springs internal to catch solenoid 510 will do the lifting, and energizing solenoid 510 will allow catches 518 to protrude out into their locked positions. Fail secure embodiments work the opposite sense, energizing solenoid 510 will lift catches 518 into their unlocked positions, and springs internal to the catch solenoid will protrude them out. In order to require no power to maintain the lock or un-locked conditions, a normally retracted solenoid 512 is used to move a teeter arm 520.

Bevels or ramps on either side of the catches 518 allow the gates to reclose, if they were opened, by allowing the top gate edges to push up catches 518 on the gate's return to its closed position. Gravity will protrude the catches 518 back out as they clear the top of gate 506, and teeter 520 can lock them if its moved (left as in FIG. 5B). So if a gate unlock is requested, any power applied to the solenoids 510 and 512 to unlock the gates need only be applied as long as gate 506 is still closed. Once it's moved open the solenoid power can be withdrawn. A reed switch 522 or other gate-closed sensor can be used with appropriate logic to realize this kind of operation.

Figure 5A:
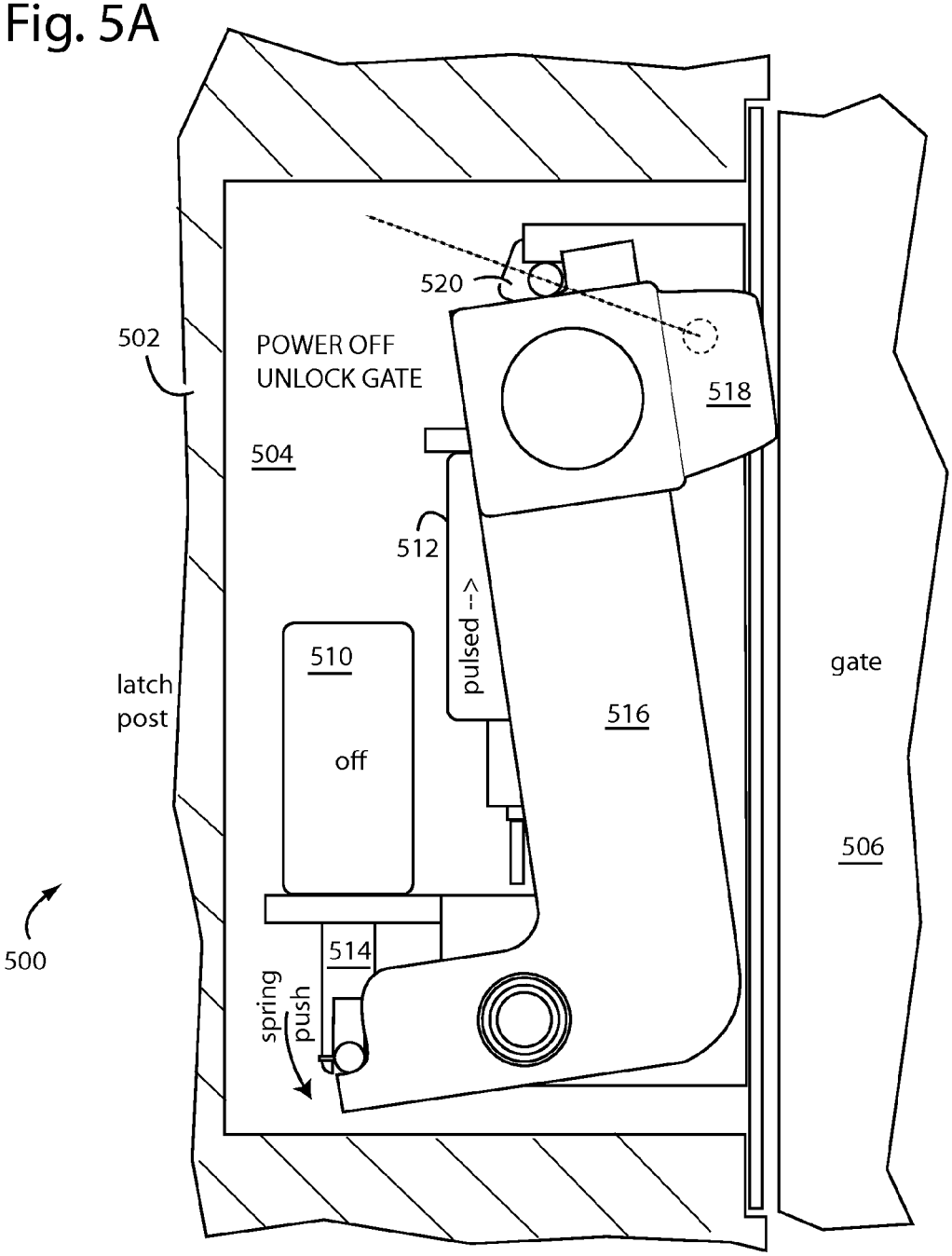
FIGS. 5A-5D are cutaway, side view diagrams of a bi-swing gate locking installation in a battery powered embodiment of the present invention that uses a lock similar to the lock of FIGS. 4A-4F, but where the teeter arm solenoid is a normally retracted type.

FIG. 5A represents one of two stable conditions that can be maintained without power being applied to either of solenoids 510 or 512. When solenoid 510 is de-energized, an internal spring will push armature 514 out and force catch arm 516 to lift catch 518. Once catch 518 is retracted up into pocket 504, gate 506 is free to swing. This, therefore is the unlocked condition.

Figure 5B:
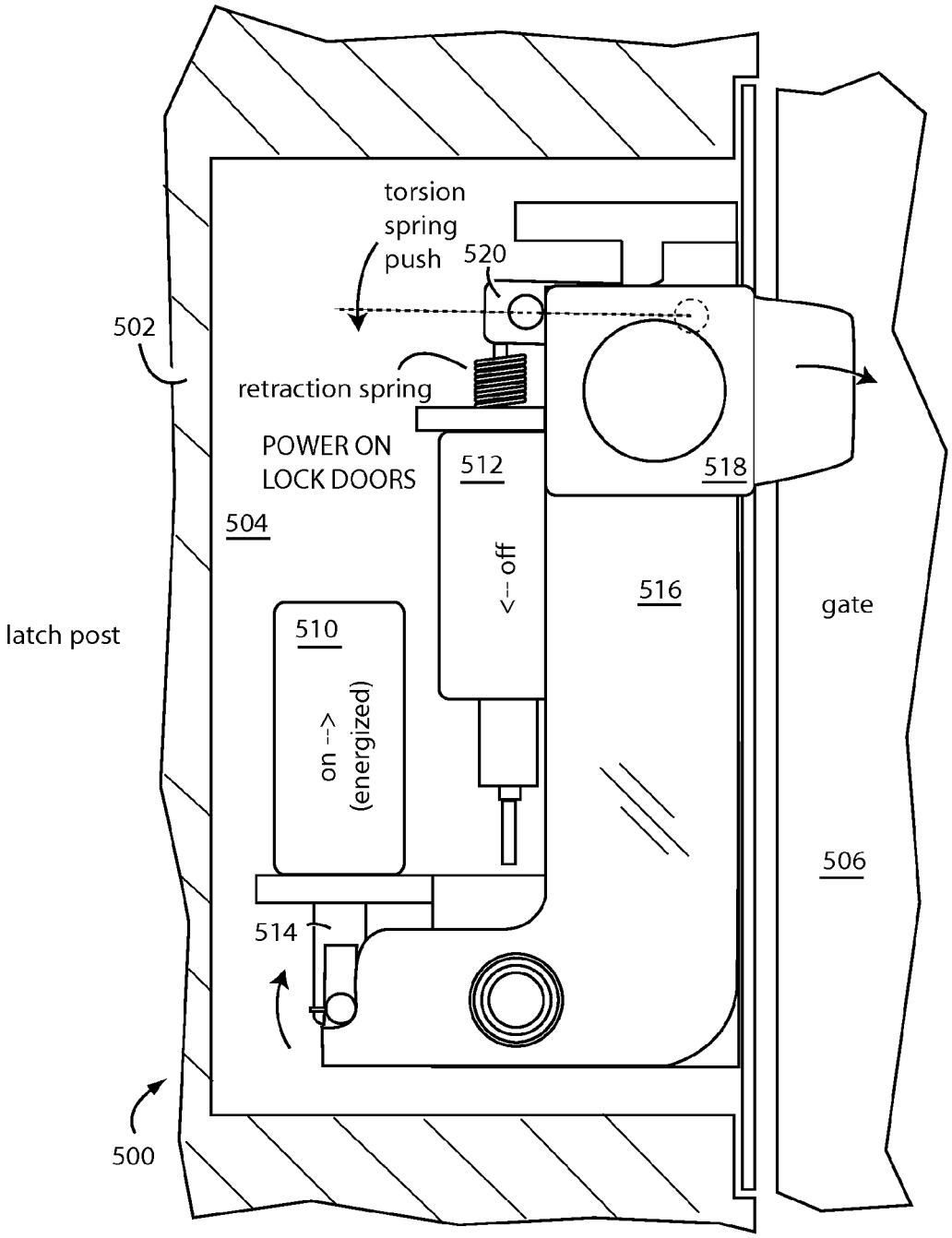

Catch arm 516 will not be able to lift up if teeter arm 520 has captured it as shown in FIG. 5B. A momentary pulse of power to solenoid 512 can be used kick teeter arm 520 over long enough to allow catch arm 516 to lift into the position shown in FIG. 5A.

FIG. 5B represents the other stable condition that can be maintained without power being maintained to either of solenoids 510 or 512. Some embodiments use a torsion spring (only seen in FIG. 4B as spring 430) that is able to pull back teeter arm 520 into the position shown in FIG. 5B whenever solenoid 512 is de-energized (the locked condition).

Figure 5C:
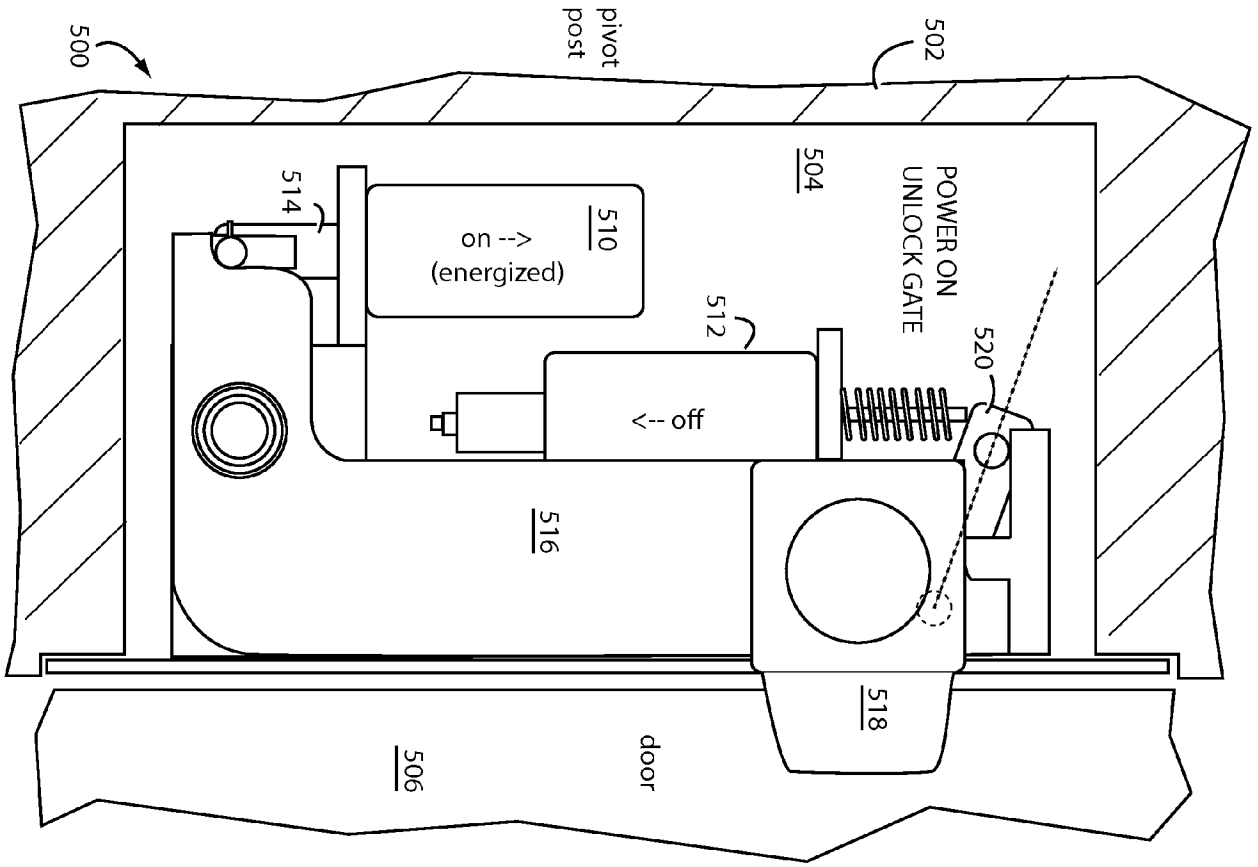

FIG. 5C represents when power is normal and the gate is to be unlocked. First, solenoid 512 is energized as shown, pushing against its internal spring to move teeter 520 out of the way of catch arm 516.

Figure 5D:
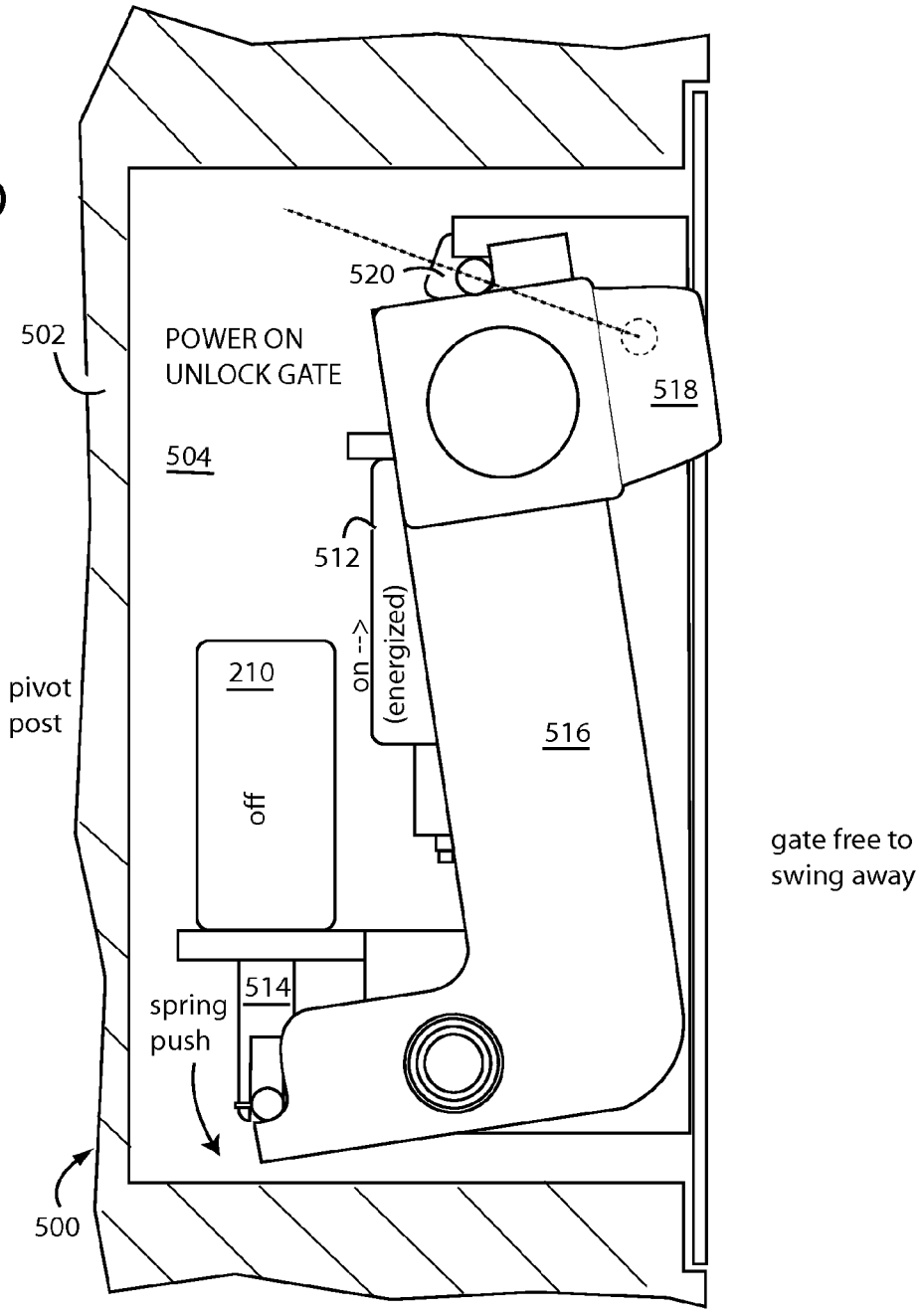

FIG. 5D represents a final step of lifting catch arms 516 up with catches 518 to thereby allow gates 506 to open.

Figure 6:
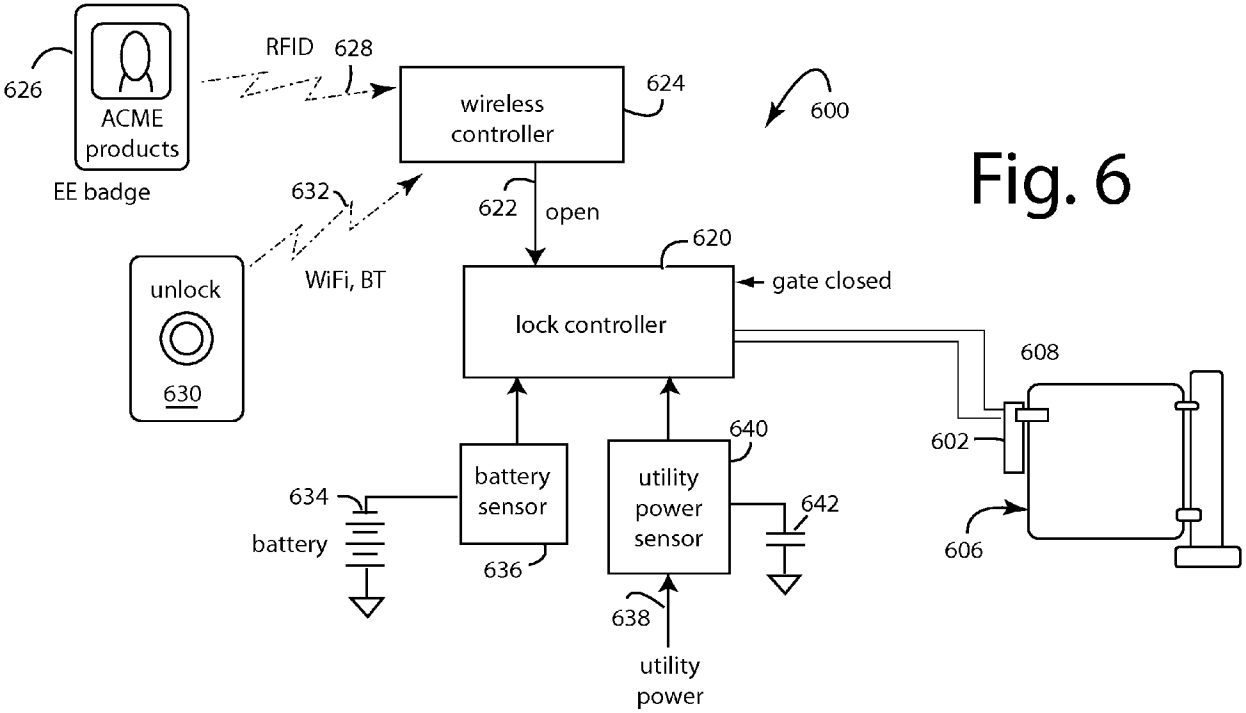
FIG. 6 is a functional block diagram of a retail store secure area gate security system in an embodiment of the present invention.

FIG. 6 represents a retail store secure area gate security system in an embodiment of the present invention, and is referred to herein by general reference numeral 600. The retail store secure area gate security system 600 places adjacent gate lock assemblies 602 and 604 in pockets in the gate casing beside a tandem set of double-acting swing gates 606. Each gate lock assembly 602 and 604 controls respective catches 608 and 610 that can be electro-mechanically lifted to allow the gates to be pushed and swung open. Such tandem set of double-acting swing gates 606 would typically be found in a large grocery or liquor store with a front retail area for the public and a back secure area only accessible to authorized employees. The gates thus separate the retail and secure area areas.

Ideally, authorized employees would be automatically detected when they head toward gates 606 and immediately allowed hands-free access, in or out of the secure area. Unauthorized persons, however, should be prevented from getting into or out of the secure area. The locks 602 and 604 need to be strong enough to resist serious attempts to bust through, and yet failsafe such that if power fails the locks will unlatch without human intervention. In alternative embodiments, the system is configured to be "fail secure", by simply not sending pulses to the teeter arm solenoid after a loss of power.

A solid-state electronics lock controller 620 includes digital logic circuits to coordinate and control two each solenoids in the adjacent gate lock assemblies 602 and 604. Such solenoids are configured like those illustrated in FIGS. 4A-4F and FIGS. 5A-5D. An "open" command 622 is received from a hardwired emergency exit button or by a wireless receiver 624 from either an RFID equipped employee badge 626 over an RFID response 628, or from an unlock remote control 630 using a Wi-Fi, Bluetooth, or other radio link 632. Lock controller 620 can be installed in its own pocket in the latch post.

Control units for battery systems should be configured to first warn the user that the battery needs changing. They should then open the lock if the battery voltage falls below a minimum level. A capacitor can be incorporated as well to provide a failsafe source of short term power should the battery be suddenly disconnected.

In some embodiments locks 602 and 604 must be failsafe due to the demands of the application, that is they must lift catches 608 and 610 when a utility power failure or battery failure occurs. For example, in battery operated applications, a common rechargeable battery 634 like those used for power tools is provided with a battery sensor 636. When a low voltage condition occurs, like is common just before a battery depletes completely, the lock controller 620 is signaled to kick locks 602 and 604 open.

In non-battery operated embodiments, two identical "normally extended" solenoids are provided to unlock and raise the arms when power is lost. So there would be no need for a capacitor. The capacitors are generally included in battery operated embodiments.

A utility powered fail-secure embodiment includes a normally retracted catch arm solenoid that requires a capacitor for power to re-lock the gates if they happened to be opened when the power was lost.

In non-battery operated models, 110-VAC utility power 638 is connected to a power sensor 640 which keeps a standby capacitor 642 charged. When the utility power fails, the lock controller 620 is signaled to kick locks 602 and 604 open. The energy needed to do that is supplied by capacitor 642. Only a shot or two on the appropriate solenoids is needed to do the trick. Preferably, 110-VAC utility powered embodiments are made failsafe without the need for a capacitor. Teeter arm solenoid is configured to be powered to hold the gates locked. When utility power is lost, the teeter arm will naturally retract under pressure from a spring. The teeter arm is held in its locked position by the torsion spring, and is pushed in to an unlocked position by a stronger internal solenoid spring.

Figure 7:
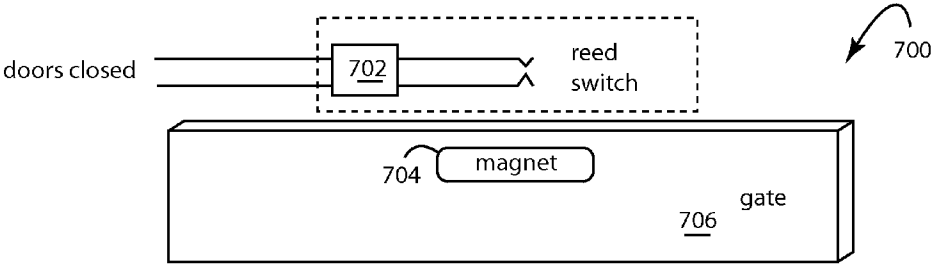
FIG. 7 is a schematic diagram of a gate closed sensing circuit that can be used to provide a switch contact to a lock controller as in FIG. 6.

FIG. 7 represents a gate closed sensing circuit 700 that can be used to provide a switch contact to lock controller 320 (FIG. 3). When locks 302 and 304 are released, gates 306 are free to swing away. The locks should not be allowed to latch back up until the gates return. In FIG. 7, a reed switch sensitive to magnetic fields is placed in the latch post or locks themselves. A permanent magnet 704 is mounted in a swinging gate 706 such that it can operate reed switch 702 when the gate is in its closed position. Other types of conventional switches and sensors are also possible.

It may be necessary to mount an additional electro-mechanical lock in the gate or the floor below it. A trap-lock at the top of the gate can catch and center the gate, an electric dead bolt mounted in the floor may be configured in some embodiments to go into a strike plate located in the center of the gate. An electric strike could also be installed in the bottom of the gate itself, and have its bolt operate into a hole in the floor.

Figure 8:
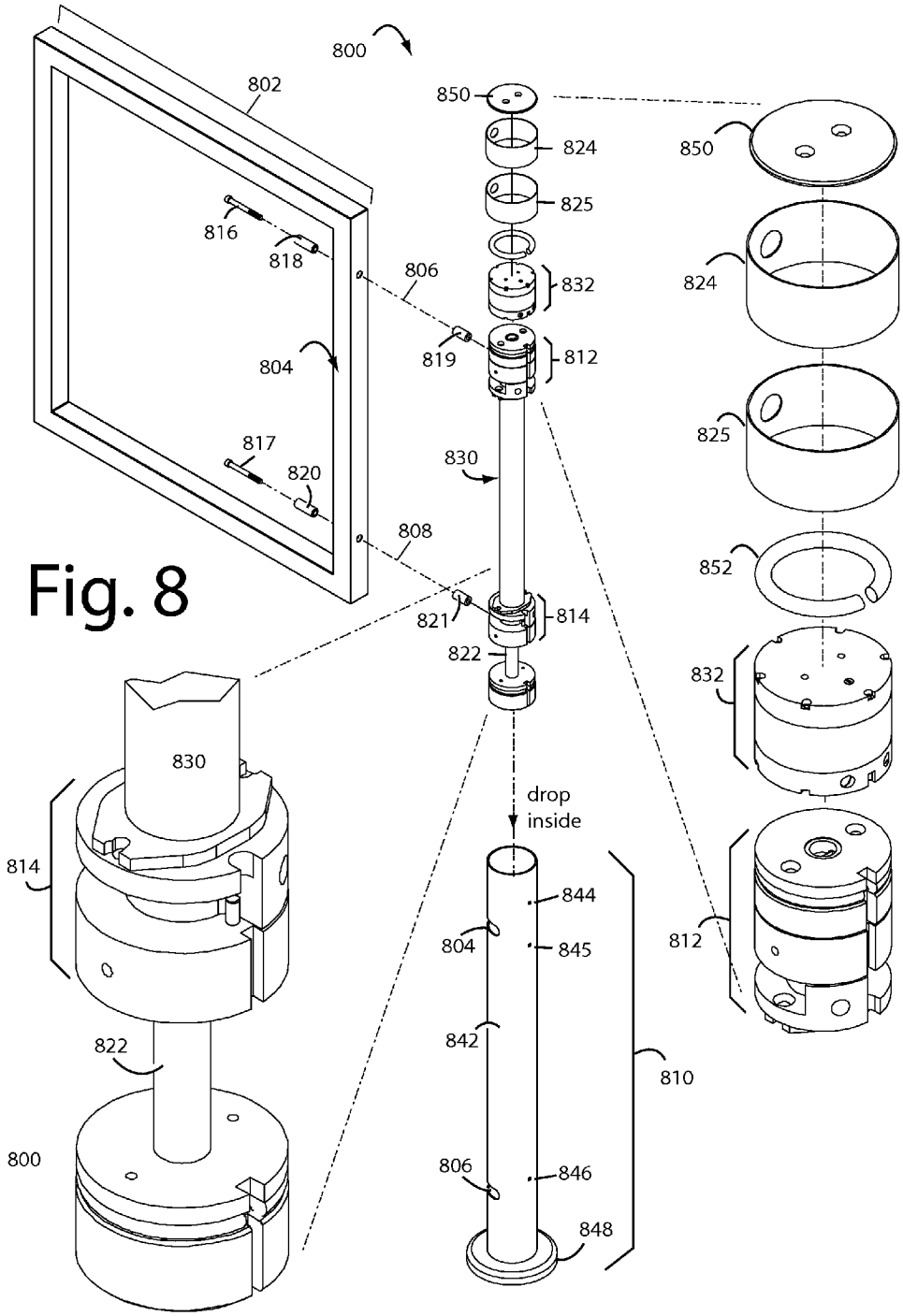
FIG. 8 is an exploded assembly view of a free standing, floor-mounted, bi-swing gate and post in an embodiment of the present invention that uses a rotary damper and torsion spring for an automatic closer.

FIG. 8 represents a free standing bi-swing gate and floor post in an embodiment of the present invention that uses a rotary damper for controlled closing, and is referred to herein by general reference numeral 800. A swing gate 802 has a stainless steel frame 804 which is hung to swing at two standardized points 806 and 808 from a 4" diameter stainless steel post 810. The two standardized points 806 and 808 permit manufacturing and stocking of a variety of interchangeable gates. Some such gates 802 may have barriers of vertical pickets or bars, glass sheets, or stainless steel panels. Some jurisdictions may require smooth surface kick panels at the bottom, e.g., the bottom ten inches.

A portion of an upper bearing 812 and a lower bearing 814 rotate with gate 802 by virtue of their attachment at standardized points 806 and 808 by bolts 816-817 and spacers 818-821. A post shaft 822 and upper and lower attachment point collars 824-825 rotate with the swing of gate 802. Spacer 819 and bolt 816 pass through a hole in upper attachment point collar 824 and attach solidly to upper bearing 812. Spacer 821 and bolt 817 pass through a hole in lower attachment point collar 825 and attach it solidly to lower bearing 814. Both collars are able to shuttle left and right in corresponding post slots 826 and 828.

A main spring 830 between upper bearing 812 and lower bearing 814 forces gate 802 to always swing back and return to its neutral (closed) position. An adjustable rotary damper 832 controls that closing by slowing down the gate's return. Access to an Allen-socket adjustment is through a small hole in post 810. In one embodiment of the present invention, rotary damper 832 slows the return of gate 802 even more as the gate approaches its closed position, e.g., to avoid overshoot and oscillation.

Pivot post 810 typically comprises a piece of 4" diameter stainless steel pipe 842 and is fitted internally with short dowel pins 844-846. These dowel pins slip into slots provided in rotary damper 832, and bearings 812 and 814. Dowel pin 845 contacts an upper spring flange and prevents it from turning in one direction. Dowel pin 846 contacts a lower spring flange and prevents it from turning clockwise. The pivot post 800 secures to the floor with a base flange 848. A post cap 850 fits on top.

A rubber centering compression ring 852 provides a snug fit and centers the assemblies inside post 842.

Figure 9:
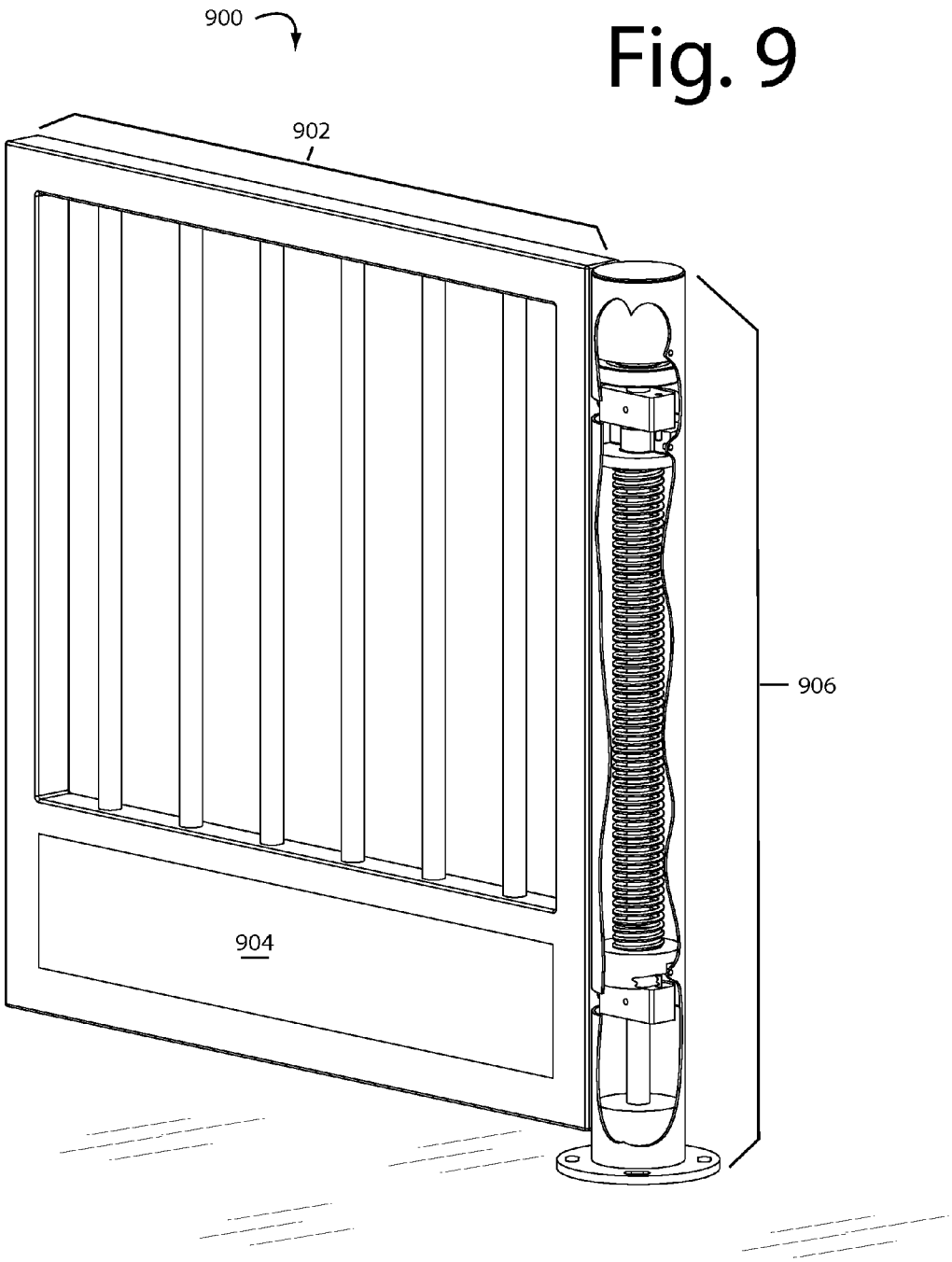
FIG. 9 is a cutaway perspective view of the free standing, floor-mounted, bi-swing gate and post of FIG. 8.

FIG. 9 represents a bi-swing gate and floor post 900 similar to that in FIG. 8 when assembled. A gate 902 includes a kick panel 904 and hangs on and swings about a floor post 906.

Figure 10:
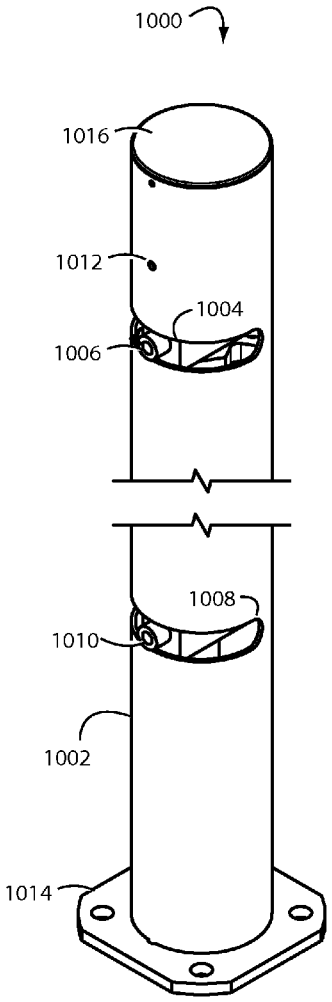
FIG. 10 is a perspective view of the free standing, floor-mounted post of FIG. 8 with details of the lateral slots that allow the gate to swing on an internal coaxial pivot.

FIG. 10 represents a bi-swing gate post 1000 similar to that in FIGS. 8 and 9. A hollow stainless steel pipe 1002 has an upper radial slot 1004 cut 180-degrees around for an upper pivot shaft spacer 1006 to travel. A lower radial slot 1008 is similarly cut 180-degrees around for a lower pivot shaft spacer 1010 to travel. The spacers are fastened tight against the gate frame. An access hole 1012 allows the closer speed to be adjusted with an Allen wrench. A mounting foot 1014 is used with fasteners to secure the post 1000 to a floor. A cap 1016 provides a weather tight seal and presents a finished appearance.

Figure 11:
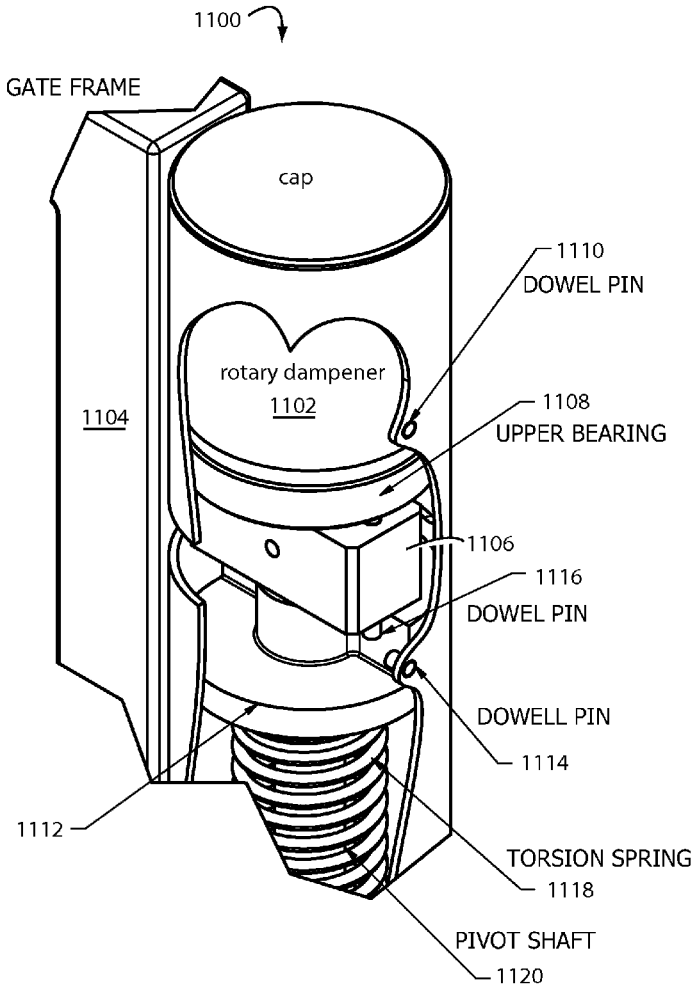
FIG. 11 is a perspective cutaway view of the top inside part of the free standing, floor-mounted post of FIG. 8 with details of the rotary dampener and upper bearing that allows the gate to swing on an internal coaxial pivot.

FIG. 11 is intended to provide more detail and a better understanding of the upper parts 1100 of a bi-swing gate like that in FIG. 9. A rotary dampener 1102 provides hydraulic resistance to any radial movement of a gate frame 1104 while attached to a hub 1106. The hub is fixed to a torque shaft and connected to the gate frame 1104. The rotary dampener 1102 sits above an upper bearing 1108 and keys into the pivot shaft at the center. A dowel pin 1110 prevents any rotation of the rotary dampener 1102 inside the post. A spring flange 1112 is allowed to rotate in a first direction but is prevented from rotating in a second direction by another dowel pin 1114. A dowel pin 1116 in the hub 1106 allows the gate opening in one direction to push spring flange 1112 in the first direction. A torsion spring 1118 is attached at the top to spring flange 1112 and its windings wind around a pivot shaft 1120.

Figure 12A:
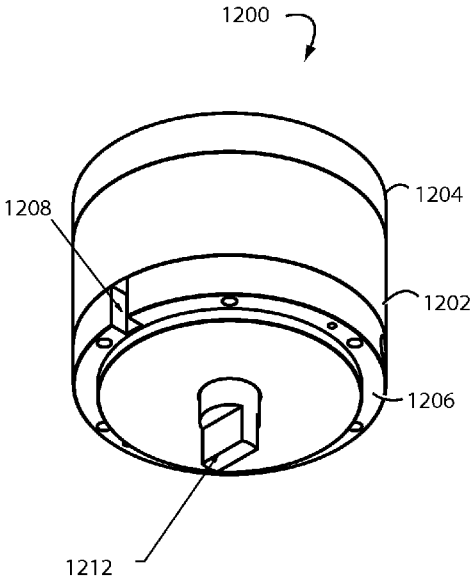
FIGS. 12A-12C are bottom perspective, exploded perspective assembly, and cutaway perspective views of the rotary dampener of FIGS. 8-11.
Figure 12B:
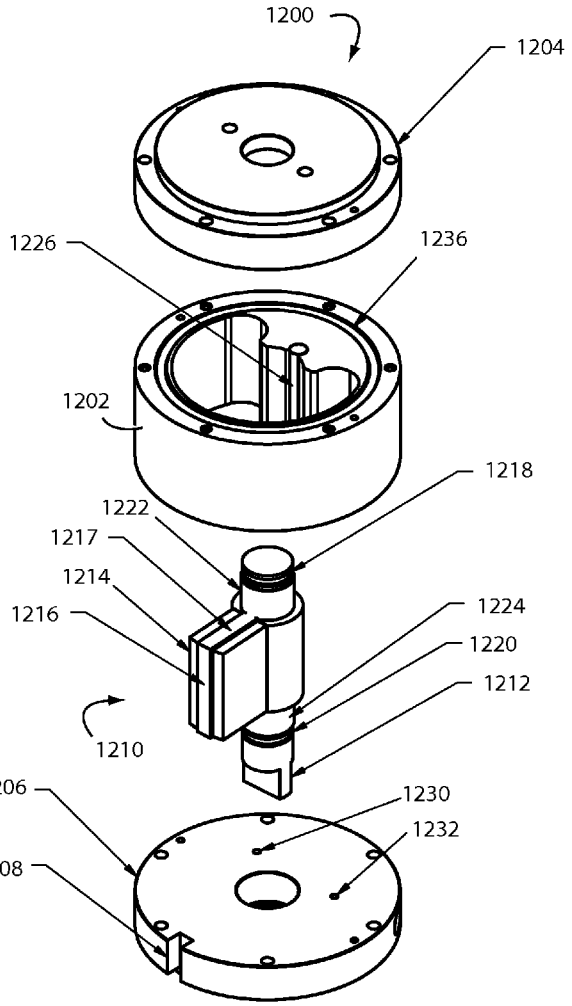
Figure 12C:
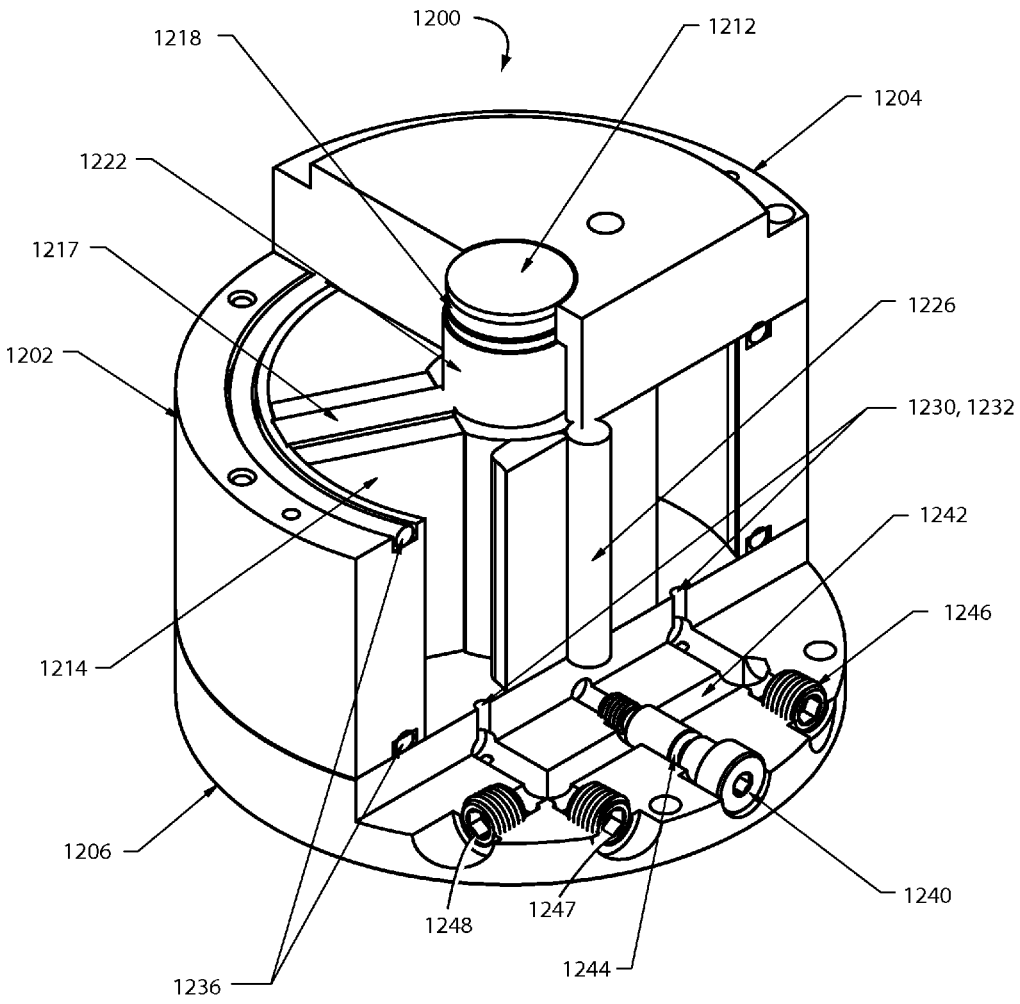

FIGS. 12A, 12B, and 12C represent a rotary dampener 1200 or "closer" similar to that of FIGS. 8 and 11. A cylindrical closer body 1202 has a top end plate 1204 and a bottom endplate 1206 with a keyway 1208 to prevent the closer from rotating inside the post. A piston assembly 1210 resembles a flag that waves around a pole. Such has a shaft 1212 with flats for locking into a slot on top of the torsion spring assembly. A flag piston 1214 has a rubber seal 1216 along its distal edges and a rubber seal 1217 on its top and bottom edges. Shaft 1212 has an upper and a lower O-ring seal 1218 and 1220 just outside an upper and a lower shaft bearing 1222 and 1224. A vertical shaft seal 1226 inside the closer body 1202 wipes against flag piston 1214. Holes 1230 and 1232 in the top surface of bottom endplate 1206 are interconnected and provide a path for hydraulic fluid that fills the closer body 1202 to flow between chambers on either side of flag piston 1214 as it moves. Two O-ring seals 1236 on the top and bottom of closer body 1202 help seal it to the respective endplates.

FIG. 12C shows in cutaway view the hydraulic circuits and adjustment screws. A closer speed adjustment screw 1240 variably blocks a channel 1242. An O-ring 1244 is positioned on closer speed adjustment screw 1240. Pipe plugs 1246-1248 are a manufacturing accommodation to make fabricating channel 1242 easier, e.g., by simple drilling.

Of particular interest herein are the embodiments of the present invention illustrated in FIGS. 8-12C. It is not necessary herein for the closer posts to be combined with a Dudley Gates Trap-lock or some other electromechanical lock. A number of important applications don't require any kind of lock, and sometimes don't even need a bi-directional gate.

Embodiments of the present invention provide a standardized closer post assembly that can be used with a multitude of similarly standard dimension gate styles. Conventional products have either external hinges or a top bracket and a floor closer. Both of which are very expensive to install.

Closer post assembly embodiments of the present invention allow architects to specify a stylistic and functional gate design that will be compatible with the adjacent barriers, whether they are glass, wood with wood veneer on the post, chrome and glass, brass, textured metal, Acrylic, etc. The lack of exposed brackets and hardware makes such an ideal choice for corporate lobbies, banks, hospitals, etc.

The hydraulic closers and dampeners herein can be removed and replaced by opening the post cap to then lift the internal closer assembly out of the top of the pivotable shaft pivot post. The gate itself remains functional while this is being done. This is a huge advantage over conventional floor closer gates. Such conventional gates have to be completely removed and set aside, so the floor closer can be removed and replaced.

The closer speed adjustment is also a significant advantage. Simply swinging open the gate allows access to the adjustment screw (which is normally hidden by the closed gate). The adjustment is convenient at waist level and allows for quick and easy speed adjustment. In contrast, conventional floor closer speed adjustments located beneath the floors is typically covered by a floor plate which has to be removed before any adjustments can be made.

The closer post constructions intended herein allow retail buyers of them the option of designing and building their own gates from catalogs. These gates must therefore have mounting features compatible with the closer posts described herein using standardized dimensions and two-points of attachment.

Although particular embodiments of the present invention have been described and illustrated, such is not intended to limit the invention. Modifications and changes will no doubt become apparent to those skilled in the art, and it is intended that the invention only be limited by the scope of the appended claims.

The invention claimed is:

1. A gate closer post assembly, comprising:

a hollow cylindrical post for vertical attachment to a floor;

a pivotable shaft disposable inside and coaxial to the hollow cylindrical post, and supported internally by upper and lower bearings that enable a gate to be supported by a two-point attachment to the pivotable shaft and to allow said gate to hinge inside the post on a central axis;

a parallel pair of lateral slots disposed in the hollow cylindrical post each correspondingly proximate to said two-point attachment, wherein a gate hung on the hollow cylindrical post and fixed to said two-point attachment to the pivotable shaft is permitted to swing between an open position and a closed position;

a torsion spring attached to the pivotable shaft so as to oppose said gate from swinging open and to automatically return the gate to said closed position;

an assembly of the pivotable shaft, said upper and lower bearings, and the torsion spring sized to fit and lock inside the hollow cylindrical post, and arranged to permit the insertion and withdrawal of the assembly as a single unit through an open top of the hollow cylindrical post; and a rotary dampener in a cylindrical housing sized to fit and lock inside the hollow cylindrical post, and having a shaft on a central axis with one outside bottom end mechanically keyed to engage a matching feature disposed on a top end of the pivotable shaft above the torsion spring and said upper and lower bearings;

wherein, the rotary dampener limits a speed of automatic closure of said gate, and is removable through the top of the hollow cylindrical post without first demounting or disabling the functioning of said gate.

2. The gate closer post assembly of claim 1, further comprising:

a gate attachment hardware for said two-point attachment to the pivotable shaft and conforming to a predetermined set of dimensions for the interchangeability and simplification of alternative gate styles.

3. The gate closer post assembly of claim 1, further comprising:

a rotary hydraulic dampener in a cylindrical housing sized to fit and lock inside the hollow cylindrical post, and having a hydraulic piston shaft on a central axis with one outside bottom end mechanically keyed to engage a matching feature disposed on a top end of the pivotable shaft above the torsion spring and said upper and lower bearings;

a hydraulic adjustment disposed in the rotary hydraulic dampener and accessible from outside the hollow cylindrical post, and providing for a variety of speed of closure settings for the automatic closure of said gate.

4. The gate closer post assembly of claim 3, further comprising:

a flag piston mounted internally on said hydraulic piston shaft and arranged to sweep between hydraulic fluid-filled chambers inside the rotary hydraulic dampener in concert with the pivotable shaft and torsion spring; and an interconnecting channel between said hydraulic chambers inside the rotary hydraulic dampener;

a screw adjustment disposed in the interconnecting channel and set to variably restrict the flow of hydraulic fluid between said hydraulic chambers.

5. The gate closer post assembly of claim 1, wherein:

the parallel pair of lateral slots disposed in the hollow cylindrical post are sufficiently long to allow said gate to operate with a bi-swing inwards and outwards as much as ±90°;

the torsion spring is attached to the pivotable shaft to allow said bi-swing inwards and outwards as much as ±90° and to automatically to return said gate to a middle closed position between two opposite open positions; and the rotary dampener is symmetrical in operation in either direction of rotation of the pivotable shaft.

6. The gate closer post assembly of claim 1, further comprising:

a pair of upper and lower slip collars disposed to shuttle outside the hollow cylindrical post and keep the parallel pair of lateral slots covered as said gate is opened and closed.

7. The gate closer post assembly of claim 1, further comprising:

a rotary closer screw adjustment included in the rotary closer; and an access hole disposed in the hollow cylindrical post proximate to an operating location of the rotary closer screw adjustment and enabling a simplified external adjustment of automatic gate closure speeds.

* * * * *